US007278357B2

(12) United States Patent
Keith et al.

(10) Patent No.: US 7,278,357 B2
(45) Date of Patent: Oct. 9, 2007

(54) ACCURACY LESS LETHAL PROJECTILE

(76) Inventors: Michael A. Keith, 2388 Glenview Dr., Hollister, CA (US) 95023; Jaime H. Cuadros, 2742 Fragancia, Hacienda Heights, CA (US) 91745

( * ) Notice: Subject to any disclaimer, the term of this patent is extended or adjusted under 35 U.S.C. 154(b) by 123 days.

(21) Appl. No.: 10/820,992

(22) Filed: Apr. 8, 2004

(65) Prior Publication Data

US 2005/0223931 A1 Oct. 13, 2005

(51) Int. Cl.
*F42B 8/12* (2006.01)

(52) U.S. Cl. ..... 102/502; 102/444

(58) Field of Classification Search ..... 102/444, 102/445, 446, 447, 502, 529
See application file for complete search history.

(56) References Cited

U.S. PATENT DOCUMENTS

| | | | | | |
|---|---|---|---|---|---|
| 2,373,363 | A * | 4/1945 | Wellcome | 102/504 |
| 3,081,703 | A * | 3/1963 | Kamp et al. | 244/3.27 |
| 3,733,727 | A * | 5/1973 | Jones et al. | 42/106 |
| 3,771,459 | A * | 11/1973 | Lohnstein | 102/282 |
| 3,771,460 | A * | 11/1973 | Ayer | 102/282 |
| 3,906,859 | A * | 9/1975 | Smith | 102/444 |
| 4,008,667 | A * | 2/1977 | Look | 102/502 |
| 4,986,185 | A * | 1/1991 | Kuhnle et al. | 102/388 |
| 5,235,915 | A * | 8/1993 | Stevens | 102/439 |
| 5,450,795 | A * | 9/1995 | Adelman | 102/444 |
| 5,898,125 | A * | 4/1999 | Mangolds et al. | 102/439 |
| 6,202,562 | B1 | 3/2001 | Brunn et al. | |
| 6,209,461 | B1 * | 4/2001 | Riffet et al. | 102/513 |
| 6,308,632 | B1 * | 10/2001 | Shaffer | 102/388 |
| 6,655,294 | B1 * | 12/2003 | Kerr | 102/502 |
| 6,820,560 | B1 * | 11/2004 | Romppanen | 102/502 |

FOREIGN PATENT DOCUMENTS

EP 0488911 * 6/1992

OTHER PUBLICATIONS

Cynthia Bir, "Less-Lethal Impact Modeling," Law and Order, p. 94-99, (Aug. 1, 2002).
Jaime Cuadros, "Beanbags as an Affective Alternative," Law and Order, p. 100-101, (Aug. 1, 2002).
Steve Ijames, "Less-Lethal," Law and Order, p. 87-93, (Aug. 1, 2002).

* cited by examiner

*Primary Examiner*—David Parsley
(74) *Attorney, Agent, or Firm*—Lewis Brisbois Bisgaard & Smith LLP; Sanford Astor

(57) ABSTRACT

A less lethal projectile comprising a hollow body filled with a high density filler, a closure to seal the filler in the body and a bore-rider stabilizer attached to the rear of the closure. The bore rider stabilizer comprises a material having a low coefficient of friction.

11 Claims, 4 Drawing Sheets

FIG. 1
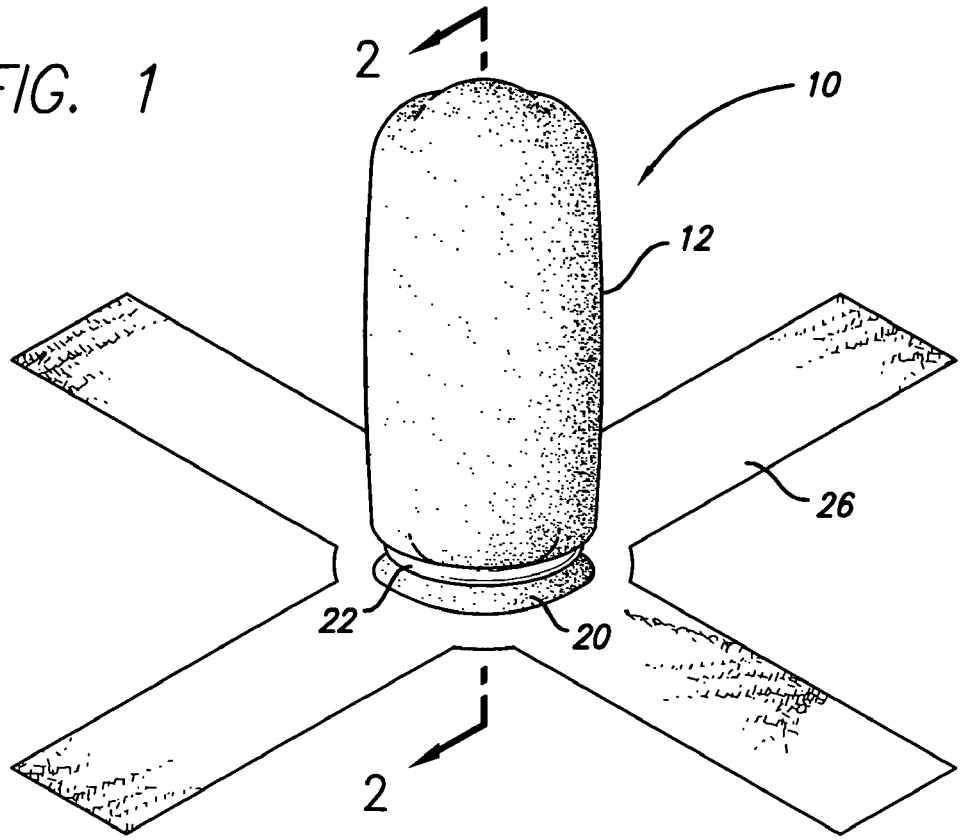
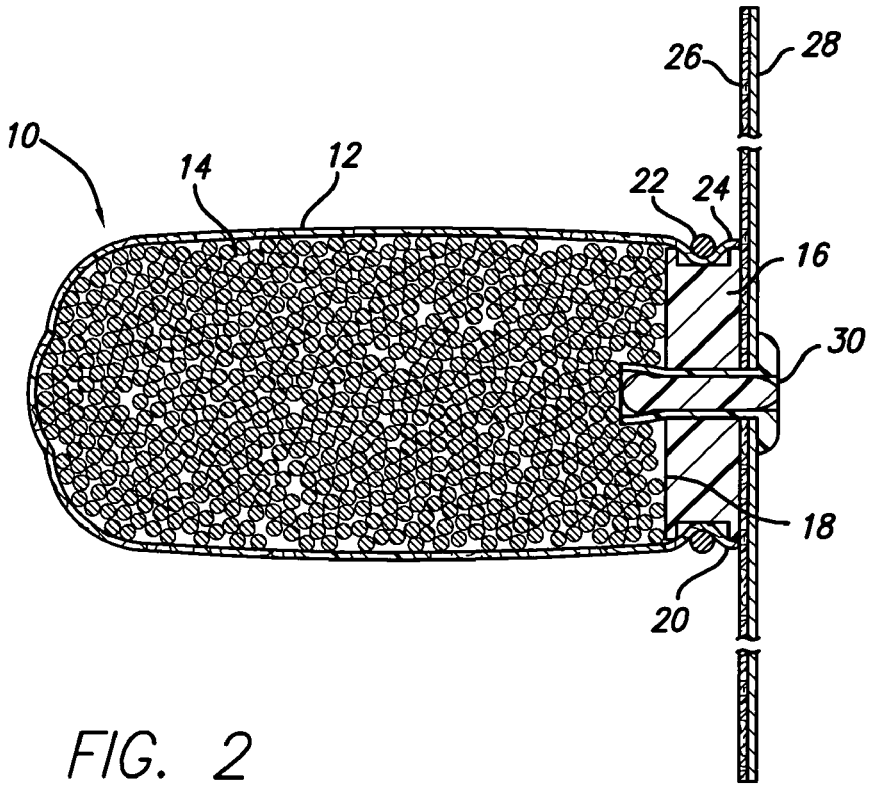
FIG. 2

ACCURACY LESS LETHAL PROJECTILE

This invention described herein has been described in our Disclosure Document No. 541419 filed Nov. 5, 2003.

BACKGROUND OF THE INVENTION

Kinetic energy impact less-lethal projectiles have been in use for over 30 years. The early less-lethal projectiles were square cloth bags or sacks filled with No. 9 lead shot. They were commonly called "bean bags". There were two sizes, a 12 gauge shotgun round containing 40 grams of lead shot and a 37 mm size containing 150 grams of lead shot. These projectiles were fired at a muzzle velocity of 230 and 300 feet per second (fps), for the shotgun, and from 110 to 250 feet per second (depending on the range) for the 37 mm rounds. The muzzle kinetic energy was about 70 and 120 ft-lbs, for the shotgun and from 70 to over 320 ft-lbs for the 37 mm projectiles.

These projectiles were widely used by the law enforcement community after it was demonstrated by experiment that the energy delivered by the impact was below the level determined to be lethal by blunt trauma impact to the heart area. The bags were rolled up inside the shotshell of the 12 ga. shotgun, and they begin to unroll at about 20 feet from the muzzle. When the bags impacted at less than the unrolling distance, the area of contact was reduced to less than 1 inch, thus raising the energy per unit area to the point where the bag could penetrate the body.

In the late 1990's a new form of bag was introduced, an aerodynamically shaped, drag stabilized projectile, U.S. Pat. No. 6,202,562, to Brunn et al. The "sock bag" as it became known, was fabricated from a coarsely woven fabric in the shape of a tube, hence the name, and was filled with # 9 lead shot and tied with a string to form the bag, leaving a tail to act as a stabilizer. This design gave a uniform impact signature as it collapsed on impact as opposed to the variable impact of a square bag, which varied from a cylindrical impact at minimal ranges, a rolled longitudinal strike at moderate ranges to a full, flat deployment at long ranges. This design proved to be more accurate than a square "bean bag". However, the method of stabilization employed, limited the accuracy of the new design, due to variables in assembly of the projectile and post firing orientation.

A subsequent development introduced a foam projectile fired from a 40 mm launcher. This design abandoned the 12 gauge size in favor of the larger diameter impact area available from the larger diameter projectiles. The increased area of impact lowers the energy density and the compression of the foam nose lowers the sharpness of the impulse transmitted to the target individual at impact. A sharp impulse is more deleterious to tissue than a softer one.

SUMMARY OF THE INVENTION

The accuracy of the projectile is the key element in the deployment of a less lethal projectile. With a high-accuracy projectile, the user can select with confidence the region of the body where the projectile will impact at any distance within the operating range, and thus reduce the probability of serious injury.

The projectile of this invention consists of four parts: a body or woven fabric container, a high-density filler (metal shot), a closure arrangement and a bore-rider stabilizer.

The body is constructed by weaving a tube, closed at one end, similarly to the weaving of a finger for a woven hand glove. The weave should be loose enough to allow radial expansion upon projectile impact. The thread used in the weaving can be, but is not limited to, cotton, polyester or a blend of fibers, including nylon, spandex, etc. An alternative construction would be a molded tube, similar to a finger from a rubber glove. Suitable materials are: Latex, Viton, Nitrile, etc. A third alternative would be, but is not limited to, a molded capsule of polyethylene plastic or a rubber compound such as an ethylene propylene diene monomer (EPDM), a silicone rubber, or polyurethane.

The filler for this finger-shaped container is one of several choices. The standard filler for this type of projectile has been #9 lead shot (bird shot) but other materials can be used, as long as they have sufficient density to bring the weight to about 20 grams to 40 grams for a 12 gauge sized projectile, and 30 grams to 150 grams for a 37 mm or 40 mm projectile. These materials could be (but are not limited to) steel or ceramic shot, silica beads, and metal powders, such as tungsten or copper or other similar materials. The materials selected can be used loose or contained in a frangible pouch or capsule made from, but not limited to, polyethylene, latex, gelatin or performed into a pellet using a binder such as Dow Corning 3110 RTV rubber with Catalyst S.

The closure is a key to the assembly of this projectile. The material can be plastic, cork, aluminum or rubber (EPDM, styrene butadiene rubber (SBR) or polyurethane). The generic form is a round drum shaped body with a hole in the center. The finger fabric structure is filled with the selected filler, tied or stitched shut at a predetermined level (volume) and the excess fabric either passed through the hole of the closure or rolled over the outside of the closure. The excess fabric is cut off after the stabilizer is inserted and a wedge binder or hot glue or similar adhesive is used to secure the assembly.

The stabilizer is the most important part of the projectile assembly. Past designs have had the problem of high friction between the projectile and the barrel as the projectile is launched out. This is due to the setback forces that push the payload against the bore rider (or pusher) thus increasing the diameter of the bag at the rear of the shot column. This increase in diameter causes higher friction between the fabric and the gun barrel, to the point of melting the synthetic fabric due to the heat generated by that friction. Square bags that were made of cotton were not subject to this friction melting.

A solution that allowed synthetic fabrics to be used in the bag assembly was to provide a slippery surface to separate the bag from the gun barrel. This spacer took the form of a sheet of plastic film (polyester (Mylar®), polytetrafluoroethylene (Teflon®, etc.) rolled around the bag at the time of assembly but discarded upon exiting the barrel. Synthetic fabrics can be woven to have more elasticity or stretch in one or two directions. This property allows the bag to expand in diameter at impact. This extra expansion is a beneficial quality, as it lowers the impact energy density of the projectile.

Another problem that the mass stabilized projectiles have, is the weak stabilizing forces available from the tail or streamer attached to the back end of the projectile. Mass stabilized projectiles fly well along the intended trajectory if they are perfectly symmetrical and cylindrical. However, cylindrical projectiles are aerodynamic unstable and eventually tumble when the aerodynamic forces are larger than the inertial forces. An example of strong stabilizing forces is a shuttlecock in a game of Badminton. The conical shaped tail is stiff and any difference in the aerodynamic forces as it flies are transmitted to the body of the projectile and thus adjust the orientation of the body to minimize asymmetrical aerodynamic drag. A limp fabric tail or streaming ribbon provides some stability that is effective over long flight times but not sufficiently stable at short flight times (distances). The end result is that mass stabilized projectiles with fabric tails have an accuracy of only about 6 inches at 25 yards.

By combining the bore-rider slick material with the tail stabilizer into one assembly, the problems of high friction and low stability forces are eliminated. The stabilizer is then very effective in correcting small flight path errors induced by the slightly irregular mass distribution in the projectile and accompanying aerodynamic forces due to these small irregularities. The accuracy of this projectile combination is about 2 inches at 25 yards.

Examples of materials suitable for this application are: polytetrafluoroethylene (PTFE), such as Teflon® impregnated cloth; PTFE impregnated glass cloth or a polyester, such as Mylar®, film on a layer of stiff fabric. These materials have sufficient stiffness at the attachment point to transmit the stabilizing forces to effect small corrections, in time, before the aerodynamic forces acting in front of the projectile cause a larger deviation on the trajectory. The slick surface of the bore rider stabilizer is placed on the outside surface when the tail stabilizer is folded back over the projectile, the slick surface will surround the projectile, aiding its ejection from the gun.

OBJECTS OF THE INVENTION

Accordingly, several objects and advantages of the invention are as follows:

An object of the present invention is to provide a less-lethal projectile, which has improved accuracy.

It is also an object of the present invention to provide a less-lethal projectile, which is easy to manufacture and effective in disabling a target.

A further object is to provide such a less-lethal projectile, which is stable in flight.

BRIEF DESCRIPTION OF THE DRAWINGS

FIG. 1 is a perspective view of the less-lethal projectile of this invention;

FIG. 2 is a cross-sectional view;

DETAILED DESCRIPTION OF THE INVENTION

Figure 3:
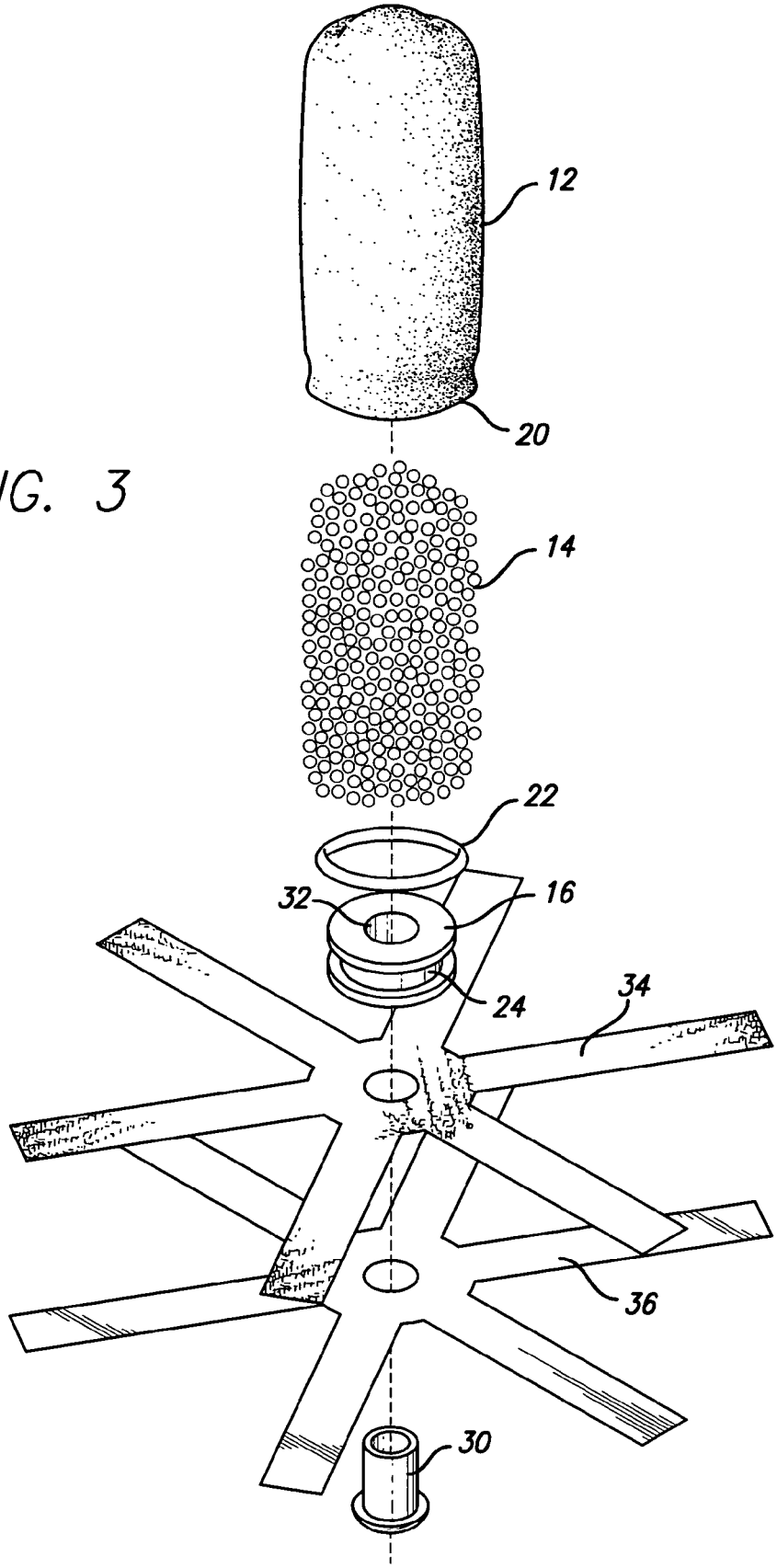
FIG. 3 is an exploded view.

Referring now to the drawings, there is shown in FIGS. 1, 2, and 3, a projectile 10 having a finger-shaped, woven fabric container 12. A metallic payload 14 is contained within container 12. A spool 16 fits inside of the open end 18 of container 12. Spool 16 is pressed against metallic payload 14 so that excess fabric 20 extends over spool 16.

An o-ring 22 is placed over excess fabric 20 at the open end 18 of container 12, o-ring 22 binding and capturing excess fabric 20 in circumferential groove 24 of spool 16. The o-ring 22 binds excess fabric 20 tightly enough that it does not pull loose during firing or flight. An o-ring that may be used is a Supervet, manufactured by Syrvet of Waukee, Ind.

Once o-ring 22 is in place, stabilizer, bore-rider 26/28 is placed against the end of spool 16 and binder 30 is fixedly attached into the bore hole 32 of spool 16. Binder 30 may be a screw or rivet or other type of binder. Spool 16 can be made from rubber, such as EPDM or SBR, plastic such as polyethylene, or wood or aluminum.

Referring to FIG. 3, there is shown a different type of stabilizer, which comprises two different stabilizers 34 and 36, which each have six lobes rather than the four of stabilizer 26. The stabilizer may have any number of lobes, such as 1, 2, 3, 4, 6, or more, depending upon the stability required for any given projectile. The stiffness of the material from which the stabilizer is made may determine the number of lobes to be used to maintain the proper angle of the stabilizer after launch. The number of lobes can be increased up to the maximum number that would fit around the inside diameter of the shotshell.

Stabilizer 26/28 is made of two materials, a flexible, loose fabric 26 and a stiffer fabric 28, bonded together. The stiffer fabric, such as a PTFE coated fabric, a plastic film or other slippery surfaced material, having a low coefficient of friction, are on the outside when the lobes are folded over container 12 and inserted into the gun barrel, which reduces friction during launch.

The stabilizer may also have only one layer made of one material, such as a high density polyethylene or an ultra-high molecular weight polyethylene, all of which have a low coefficient of friction and good flexibility. Other single layer materials which may be utilized are, 3-5 mil PTFE coated glass cloth or 3-5 mil polyester (Mylar®). For added stiffness, if desired, a second layer may be added to any of the single materials, one layer of a material having a low coefficient of friction, such as PTFE coated glass cloth, and a second stiffer layer made of polyester film, such as 3-10 mil Mylar®. Other film materials may be substituted for Mylar®, such as cellulose acetate.

PTFE has a coefficient of friction of 0.1, ultra-high molecular weight polyethylene 0.17 and Mylar® 0.23. For the stabilizer herein, a coefficient of friction of less than 0.50 is desired.

Figure 4:
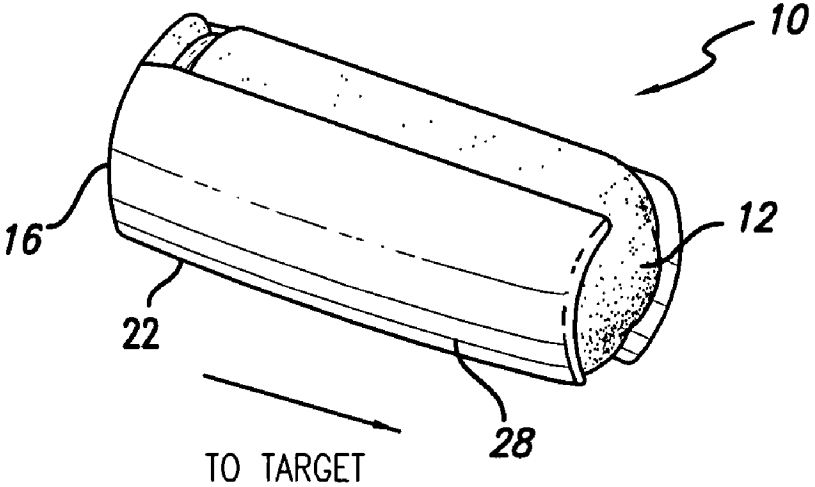
FIG. 4 is a perspective view of the projectile as it emerges from a gun.
Figure 5:
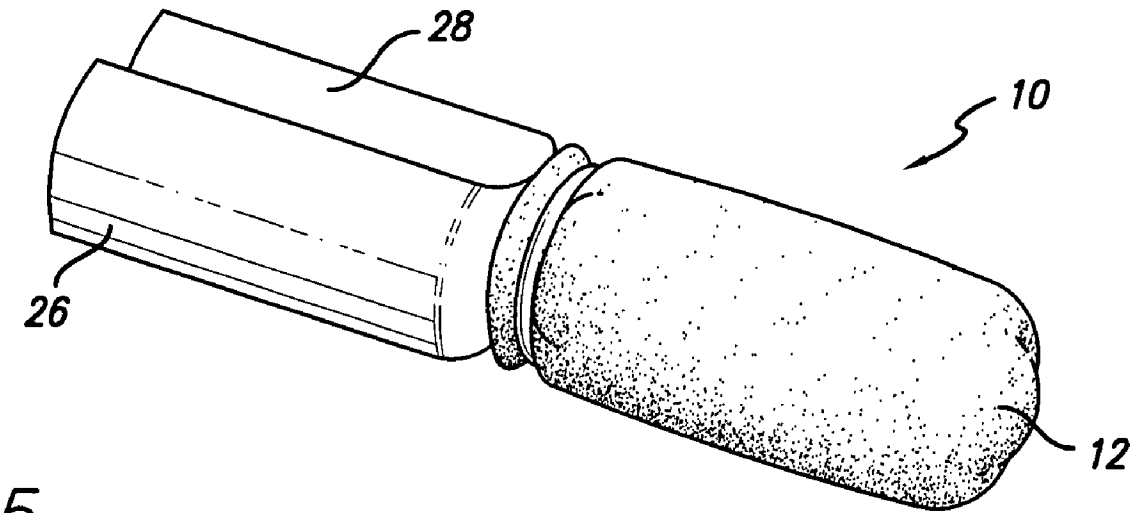
FIG. 5 is a perspective view of the projectile in free flight.

FIG. 4 shows the projectile 10 as it emerges from the gun. The lobes of stabilizer 26/28 are folded forward against container 12. Quickly after emerging from the gun, aerodynamic forces, acting in front of projectile 10, force the lobes of stabilizer 26/28 to reverse and deploy as shown in FIG. 5.

The lobes of stabilizer 26/28 when folded back over container 12, with the slick layer on the outside, adjacent the gun barrel, act as a bore-rider which cuts down the sliding friction of projectile 10 as it is launched.

Figure 6:
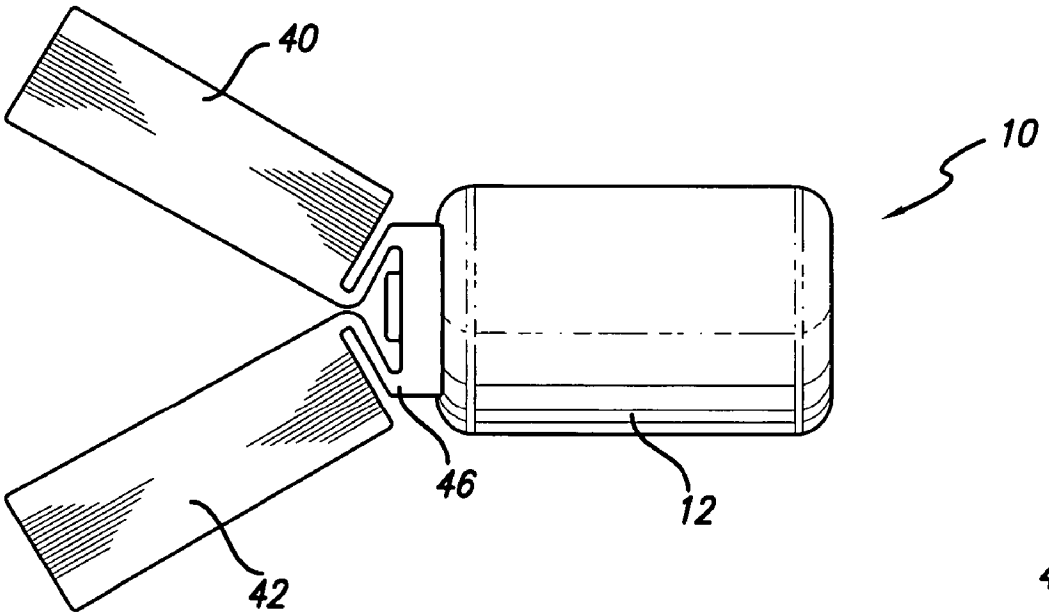
FIG. 6 is a side view of another embodiment.
Figure 7:
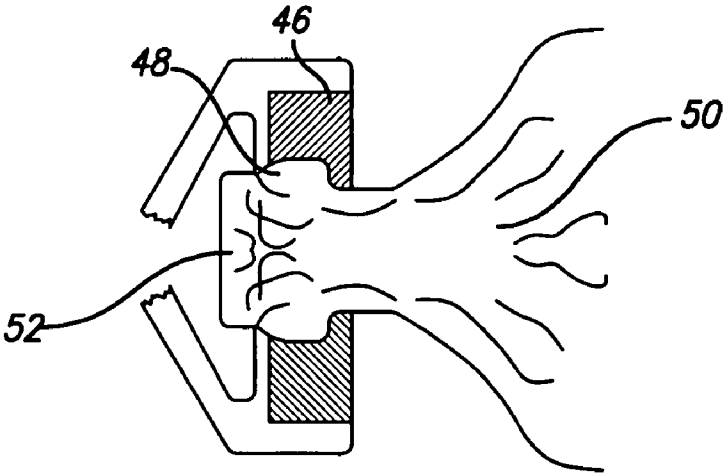
FIG. 7 is cross-sectional view of the spool of FIG. 6.

FIGS. 6 & 7 show stabilizer, bore-rider 40/42 molded as one piece onto spool 46. The spool stabilizer combination has a concentric hole 48 in spool 46 to pass and capture excess fabric 50 of the payload container. The fabric is then hot-glued 52 in place or a wedge keeper placed in the hole to trap the fabric 50 and then be hot glued in place.

Another method of assembly of the projectile is to tie the excess fabric with a strong waxed linen cord such as Victor MRT waxed linen lasing 4 cord manufactured by Ludlow Textiles Company, Inc. of Ludlow, Me.

Tests were conducted comparing the accuracy of the design of this invention as compared to other common systems, as follows:

DRAG STABILIZED "BEAN BAG" ACCURACY COMPARISON

| MANUFACTURER: PRODUCT NAME: PART NO. | DEFENSE TECHNOLOGY 23DS DRAG STABILIZER 3027 | | | MK BALLISTIC SYSTEMS AERO-DRAG STABILIZED 4020-S | | | MK BALLISTIC SYSTEMS QT-4 AERO-SOCK (DESIGN OF PATENT) | | |
|---|---|---|---|---|---|---|---|---|---|
| RANGE | WEAPON | GROUP | RNDS/GRP | WEAPON | GROUP | RNDS/GRP | WEAPON | GROUP | RNDS/GRP |
| 60 FT | M 590 | 4.5 INCH | 4 | M590 | 3.5 INCH | 4 | M590 | 2.1 INCH | 5 |

M590 is a Mossberg Military 12 Gauge Shotgun with adjustable sights and a cylinder bore.

M590 is a Mossberg Military 12 Gauge Shotgun with adjustable sights and a cylinder bore.

Expansion:

The QT-4 Aero-Sock was tested against Ballistic Gelatin prepared according to the Los Angeles Police Department Specification. This used Knox 250A Ordnance Gelatin cast in blocks and stored at 40 degrees Fahrenheit. The bag expanded to a full two inches when fired from a rifled barrel and bounced off the gelatin. This is highly advantageous as it shows that it will not penetrate a person's skin. The same bag fired at gelatin from a smooth bore only slightly penetrated the block and bounced off, showing that the bag material selection enhances the non-lethal performance by insuring the bag distributes its energy over a broad surface area.

The materials selected for the bag material were synthetic materials that have good expansion, polyester and lycra. These showed good expansion and strength on impact. The Los Angeles County Sheriff's Department indicated that the projectile of this invention was the only one that did not fail on impact with an angled steel plate.

Having thus described the invention,

We claim:

1. A less lethal projectile adapted to be loaded into a cartridge case to form a loaded cartridge, said less lethal projectile coniprising a finger-shaped woven fabric container having a closed end and an open end, said container filled with a high-density filler, a spool closure, having a bore bole therein, said spool closure located inside of the open end of the fabric container, a sealer wrapped tightly around the spool closure to seal the filler in the container, a bore-rider stabilizer which is not a part of the fabric container attached directly to the rear of the projectile, said bore rider stabilizer comprising a fabric or film having a surface with a low coefficient of friction and a binder attached into the bore hole of said spool to bind the bore rider stabilizer to the rear of the projectile.

2. A less lethal projectile adapted to be loaded into a cartridge case to form a loaded cartridge, said less lethal projectile comprising a fabric body container having a closed front end and an open rear end, filled with a high-density filler, a spool having a hole through it, through which is passed the rear end of the fabric body, a bore-rider stabilizer attached directly to the rear of the projectile, said bore-rider stabilizer comprising a fabric or film having a low coefficient of friction, an adhesive to seal the rear end of the fabric in the hole of the spool.

3. The projectile of claim 1 or 2 in which the container is made of a woven fabric, plastic or rubber.

4. The projectile of claim 1 or 2 in which the high density filler comprises steel, lead or ceramic shot, silica beads, metal beads, metal powder or mixtures thereof.

5. The projectile of claim 1 or 2 in which the high density filler is contained within a frangible pouch or capsule or formed into a pellet.

6. The projectile of claim 1 or 2 in which the closure comprises a round, drum shaped body having a hole in the center and a circumferential groove and an o-ring fitted into the circumferential groove.

7. The projectile of claim 1 or 2 in which the bore-rider stabilizer comprises a plurality of tail lobes.

8. The projectile pf claim 1 or 2 in which the bore-rider stabilizer is a single layer of material made of high density polyethylene, ultra high molecular weight polyethylene, polytetrafluoroethylene coated glass cloth, or 3-5 mil polyester.

9. The projectile of claim 1 or 2 in which the bore-rider stabilizer comprises two layers, a first fabric layer and a second layer having a low coefficient of friction.

10. The projectile of claim 1 or 2 in which the bore-rider stabilizer comprises two layers, a first layer made of high density polyethylene, ultra high molecular weight polyethylene, polytetrafluoroethylene coated glass cloth, or 3-5 mil polyester and a second layer made of a polyester film or cellulose acetate.

11. The projectile of claim 1 or 2 comprising a fabric container having a loose weave, which allows radial expansion upon impact.

* * * * *